US007832335B2

(12) United States Patent
Rastegar et al.

(10) Patent No.: US 7,832,335 B2
(45) **Date of Patent: *Nov. 16, 2010**

(54) AXIALLY COMPACT AND LOW-VOLUME MECHANICAL IGNITER FOR THERMAL BATTERIES AND THE LIKE

(75) Inventors: Jahangir S. Rastegar, Stony Brook, NY (US); Richard T. Murray, Brentwood, NY (US)

(73) Assignee: Omnitek Partners LLC, Bayshore, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/234,698

(22) Filed: Sep. 21, 2008

(65) Prior Publication Data

US 2010/0071577 A1 Mar. 25, 2010

(51) Int. Cl.
*F42C 15/24* (2006.01)
*F42C 15/34* (2006.01)

(52) U.S. Cl. ..... 102/216; 102/247; 102/253

(58) Field of Classification Search ..... 102/216, 102/247, 253

See application file for complete search history.

(56) References Cited

U.S. PATENT DOCUMENTS 3,814,018 A * 6/1974 Daniel ..... 102/253
3,842,740 A * 10/1974 Mirlesse ..... 102/487
4,449,455 A * 5/1984 Halssig ..... 102/234
4,487,127 A * 12/1984 Luebbers ..... 102/253
4,969,397 A * 11/1990 Gunther et al. ..... 102/233
5,872,324 A * 2/1999 Watson et al. ..... 102/265
6,536,347 B1 * 3/2003 Zacharin ..... 102/274
7,437,995 B2 * 10/2008 Rastegar et al. ..... 102/216
7,587,980 B2 * 9/2009 Rastegar et al. ..... 102/253
2008/0217144 A1 * 9/2008 Honer et al. ..... 200/61.47

* cited by examiner

*Primary Examiner*—Bret Hayes

(57) ABSTRACT

An inertial igniter for use with a thermal battery for producing power upon acceleration is provided. The inertial igniter including: a base; at least one member disposed on the base, the at least one member having a hole; a mass movable towards the base, the mass having a concave portion; a locking ball disposed in the hole in the at least one member and having a portion thereof disposed in the concave portion for preventing relative movement of the mass with the base when an acceleration time profile is below a predetermined threshold; and a biasing spring including a portion for preventing the locking ball from leaving the concave portion when the acceleration time profile is below the predetermined threshold and for allowing the locking ball to leave the concave portion when the acceleration time profile is below the predetermined threshold to unlock the mass and permit movement of the mass relative to the base.

24 Claims, 12 Drawing Sheets

AXIALLY COMPACT AND LOW-VOLUME MECHANICAL IGNITER FOR THERMAL BATTERIES AND THE LIKE

GOVERNMENT RIGHTS

The U.S. Government has a paid-up license in this invention and the right in limited circumstances to require the patent owner to license others on reasonable terms as provided for by the terms of SBIR Grant No. DAAE30-03-C-1077 awarded by the Department of Defense on Jul. 17, 2006.

BACKGROUND OF THE INVENTION

1. Field of the Invention

The present invention relates generally to mechanical igniters, and more particularly to axially compact and low-volume mechanical igniters for thermal batteries and the like.

2. Prior Art

Thermal batteries represent a class of reserve batteries that operate at high temperature. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby makinu the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the tiring acceleration. The inertial igniters do not require onboard batteries for their operation and are thereby often used in high-G munitions applications such as in gun-fired munitions and mortars.

In general, the inertial igniters, particularly those that are designed to operate at relatively low impact levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

In recent years, new improved chemistries and manufacturing processes have been developed that promise the development of lower cost and higher performance thermal batteries that could be produced in various shapes and sizes, including their small and miniaturized versions. However, the existing inertial igniters are relatively large and not suitable for small and low power thermal batteries, particularly those that are being developed for use in miniaturized fuzing, future smart munitions, and other similar applications.

The need to differentiate accidental and initiation accelerations by the resulting impulse level of the event necessitates the employment of a safety system which is capable of allowing initiation of the igniter only during high total impulse levels. The safety mechanism can be thought of as a mechanical delay mechanism, after which a separate initiation system is actuated or released to provide ignition of the pyrotechnics. An inertial igniter that combines such a safety system with an impact based initiation system and its alternative embodiments are described herein together with alternative methods of initiation pyrotechnics.

Inertia-based igniters must therefore comprise two components so that together they provide the aforementioned mechanical safety (delay mechanism) and to provide the required striking action to achieve ignition of the pyrotechnic elements. The function of the safety system is to fix the striker in position until a specified acceleration time profile actuates the safety system and releases the striker, allowing it to accelerate toward its target under the influence of the remaining portion of the specified acceleration time profile. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

In addition to having a required acceleration time profile which will actuate the device, requirements also commonly exist for non-actuation and survivability. For example, the design requirements for actuation for one application are summarized as:

1. The device must fire when given a |square| pulse acceleration of 900 G 150 G for 15 ms in the setback direction.

2. The device must not fire when given a |square| pulse acceleration of 2000 G for 0.5 ms in any direction.

3. The device must not actuate when given a ½-sine pulse acceleration of 490 G (peak) with a maximum duration of 4 ms.

4. The device must be able to survive an acceleration of 16,000 G, and preferably be able to survive an acceleration of 50,000 G.

A schematic of a cross-section of a conventional thermal battery and inertial igniter assembly is shown in FIG. 1. In thermal battery applications, the inertial igniter 10 (as assembled in a housing) is generally positioned above the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total volume that the thermal battery assembly 16 occupies within a munitions housing, it is therefore important to reduce the height of the inertial igniter 10. This is particularly important for small thermal batteries since in such cases the inertial igniter height with currently available inertial igniters can be almost the same order of magnitude as the thermal battery height.

With currently available inertial igniters, a schematic of which is shown in FIG. 1 the inertial igniter 20 may have to be positioned within a housing 21 as shown in FIG. 3, particularly for relatively small igniters. The housing 21 and the thermal battery housing 11 may share a common cap 22, with the opening 25 to allow the ignition lire to reach the pyrotechnic material 24 within the thermal battery housing. As the inertial igniter is initiated, the sparks can ignite intermediate materials 23, which can be in the form of thin sheets to allow for easy ignition, which would in turn ignite the pyrotechnic materials 24 within the thermal battery through the access hole 25.

A schematic of a cross-section of a currently available inertial igniter 20 is shown in FIG. 2 in which the acceleration is in the upward direction (i.e., towards the top of the paper). The igniter has side holes 26 to allow the ignition fire to reach the intermediate materials 23 as shown in FIG. 3, which necessitate the need for its packaging in a separate housing, such as in the housing 21. The currently available inertial igniter 20 is constructed with an igniter body 60. Attached to the base 61 of the housing 60 is a cup 62, which contains one part of a two-part pyrotechnic compound 63 (e.g. potassium chlorate). The housing 60 is provided with the side holes 26 to allow the ignition fire to reach the intermediate materials 23 as shown in FIG. 3. A cylindrical shaped part 64, which is free to translate along the length of the housing 60, is positioned inside the housing 60 and is biased to stay in the top portion of the housing as shown in FIG. 2 by the compressively preloaded helical spring 65 (shown schematically as a heavy line). A turned part 71 is firmly attached to the lower portion of the cylindrical part 64. The tip 72 of the turned part 71 is provided with cut rings 72*a*, over which is covered with the second part of the two-part pyrotechnic compound 73 (e.g. red phosphorous).

A safety component 66, which is biased to stay in its upper most position as shown in FIG. 2 by the safety spring 67 (shown schematically as a heavy line), is positioned inside the cylinder 64, and is free to move up and down (axially) in the cylinder 64. As can be observed in FIG. 2, the cylindrical part 64 is locked to the housing 60 by setback locking balls 68. The setback locking balls 68 lock the cylindrical part 64 to the housing 60 through holes 69*a* provided on the cylindrical part 64 and the housing 60 and corresponding holes 69*b* on the housing 60. In the illustrated configuration, the safety component 66 is pressing the locking halls 68 against the cylindrical part 64 via the preloaded safety spring 67, and the flat portion 70 of the safety component 66 prevents the locking balls 68 from moving away from their aforementioned locking position. The flat portion 70 of the safety component 66 allows a certain amount of downward movement of the safety component 66 without releasing the locking balls 68 and thereby allowing downward movement of the cylindrical part 64. For relatively low axial acceleration levels or higher acceleration levels that last a very short amount of time, corresponding to accidental drops and other similar situations that cause safety concerns, the safety component 66 travels up and down without releasing the cylindrical part 64. However, once the firing acceleration profiles are experienced, the safety component 66 travels downward enough to release balls 68 from the holes 69*b* and thereby release the cylindrical part 64. Upon the release of the safety component 66 and appropriate level of acceleration for the cylindrical part 64 and all other components that ride with it to overcome the resisting force of the spring 65 and attain enough momentum, then it will cause impact between the two components 63 and 73 of the two-part pyrotechnic compound with enough strength to cause ignition of the pyrotechnic compound.

The aforementioned currently available inertial igniters have a number of shortcomings for use in thermal batteries, specifically, they are not useful for relatively small thermal batteries for munitions with the aim of occupying relatively small volumes. i.e., to achieve relatively small height total igniter compartment height 13. FIG. 1. Firstly, the currently available inertial igniters, such as that shown in FIG. 2 are relatively long thereby resulting in relatively long total igniter heights 13. Secondly, since the currently available igniters are not sealed and exhaust the ignition fire out from the sides, they have to be packaged in a housing 21, usually with other ignition material 23, thereby increasing the height 13 over the length of the igniter 20 (see FIG. 3). In addition, since the pyrotechnic materials of the currently available igniters 20 are not sealed inside the igniter, they are prone to damage by the elements and cannot usually be stored for long periods of time before assembly into the thermal batteries unless they are stored in a controlled environment.

SUMMARY OF THE INVENTION

A need therefore exists for novel miniature inertial igniters for thermal batteries used in gun fired munitions, particularly for small and low power thermal batteries that could be used in fuzing and other similar applications, thereby eliminating the need for external power sources. The innovative inertial igniters can be scalable to thermal batteries of various sizes, in particular to miniaturized igniters for small size thermal batteries. Such inertial igniters must be safe and in general and in particular they should not initiate if dropped. e.g., from up to 7 feet onto a concrete floor for certain applications; should withstand high firing accelerations, for example up to 20-50.000 Gs; and should be able to be designed to ignite at specified acceleration levels when subjected to such accelerations for a specified amount of time to match the firing acceleration experienced in a gun barrel as compared to high G accelerations experienced during accidental falls which last over very short periods of time, for example accelerations of the order of 1000 Gs when applied for 5 msec as experienced in a gun as compared to for example 2000 G acceleration levels experienced during accidental fall over a concrete floor but which may last only 0.5 msec. Reliability is also of much concern since the rounds should have a shelf life of up to 20 years and could generally be stored at temperatures of sometimes in the range of 65 to 165 degrees F. This requirement is usually satisfied best if the igniter pyrotechnic is in a sealed compartment. The inertial igniters must also consider the manufacturing costs and simplicity in design to make them cost effective for munitions applications.

To ensure safety and reliability, inertial igniters should not initiate during acceleration events which may occur during manufacture, assembly, handling, transport, accidental drops, etc. Additionally, once under the influence of an acceleration profile particular to the firing of ordinance from a gun, the device should initiate with high reliability. In many applications, these two requirements often compete with respect to acceleration magnitude, but differ greatly in impulse. For example, an accidental drop may well cause very high acceleration levels—even in some cases higher than the firing of a shell from a gun. However, the duration of this accidental acceleration will be short, thereby subjecting the inertial igniter to significantly lower resulting impulse levels. It is also conceivable that the igniter will experience incidental low but long-duration accelerations, whether accidental or as part of normal handling, which must be guarded against initiation. Again, the impulse given to the miniature inertial igniter will have a great disparity with that given by the initiation acceleration profile because the magnitude of the incidental long-duration acceleration will be quite low.

Those skilled in the art will appreciate that the inertial igniters disclosed herein may provide one or more of the following advantages over prior art inertial igniters;

provide inertial igniters that are significantly shorter and smaller in volume than currently available inertial igniters for thermal batteries or the like, particularly relatively small thermal batteries to be used in munitions without occupying very large volumes;

provide inertial igniters that can be mounted directly onto the thermal batteries without a housing (such as housing 21 shown in FIG. 3), thereby allowing even a smaller total height and volume for the inertial igniter assembly;

provide inertial igniters that can directly initiate the pyrotechnics materials inside the thermal battery without the need for intermediate ignition material (such as the additional material 23 shown in FIG. 3) or a booster;

provide inertia igniters that could be constructed to guide the pyrotechnic flame essentially downward (in the direction opposite to the direction of the firing acceleration—usually for mounting on the top of the thermal battery as shown in FIG. 3), or essentially upward (in the direction opposite of the firing acceleration—usually for mounting at the bottom of the thermal battery), or essentially sidewise (lateral to the direction of the firing);

provide inertial igniters that allow the use of standard off-the-shelf percussion cap primers instead of specially designed pyrotechnic components; and provide inertial igniters that can be sealed to simplify storage and increase their shelf life.

Accordingly, inertial igniters for use with thermal batteries for producing power upon acceleration are provided.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 4:
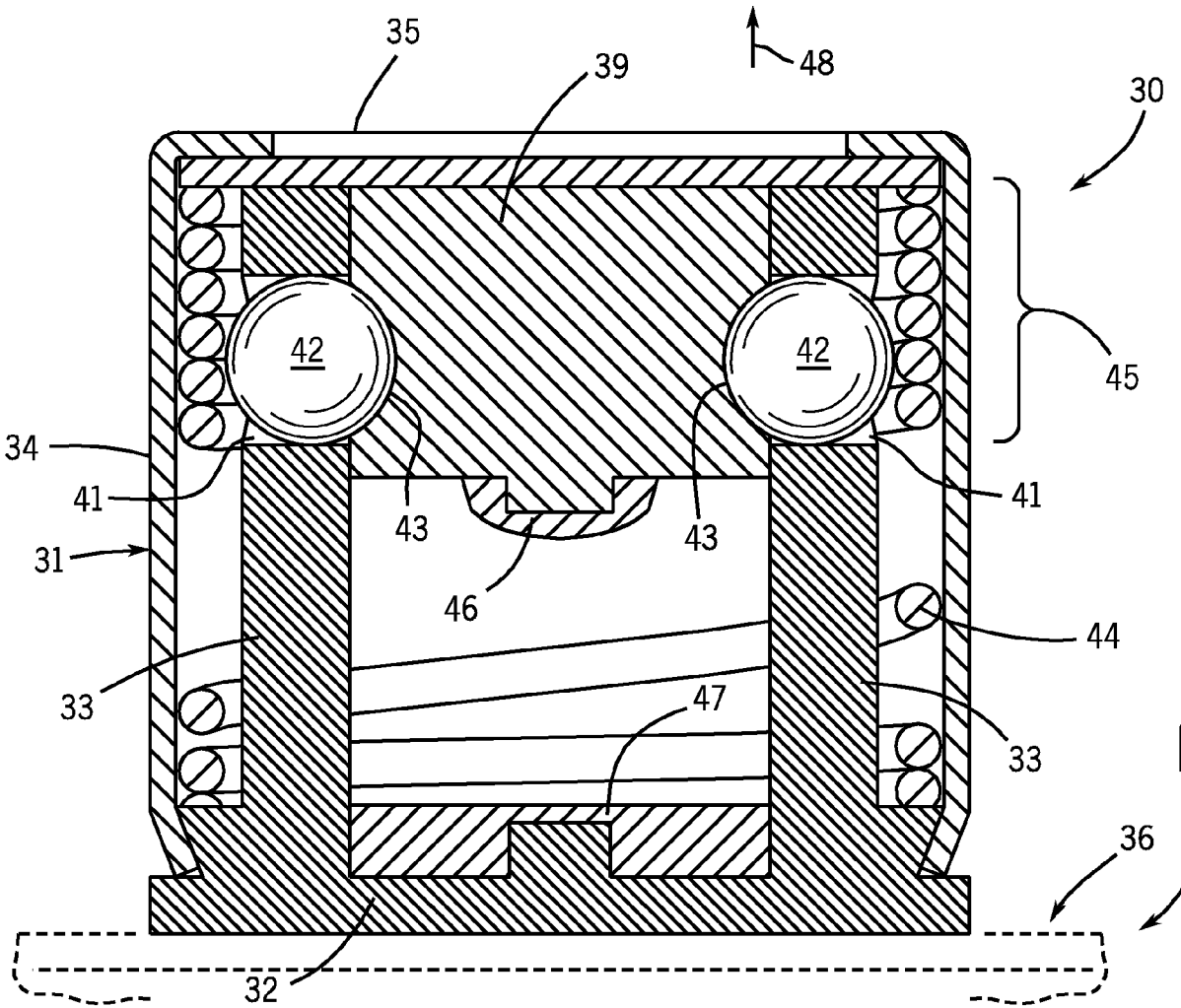

A schematic of a cross-section of a first embodiment of an inertia igniter is shown in FIG. 4, referred to generally with reference numeral 30. The inertial igniter 30 is constructed with igniter body 31, consisting of a base 32 and at least two posts 33, and a housing wall 34. The base 32 and two posts 33, which may be integral or may have been constructed as separate pieces and joined together, for example by welding of press fitting or other methods commonly used in the art. In the schematic of FIG. 4, the igniter body 31 and the housing wall 34 are shown to be joined together at the base 32; however, the two components may be integrated as one piece and a separate top cap 35 may then be provided, which is then joined to the top surface of the housing 34 following assembly of the igniter (in the schematic of FIG. 4 the top cap 35 is shown as an integral part of the housing 34). In addition, the base of the housing 32 may be extended to form the cap 36 of the thermal battery 37, the top portion of which is shown with dashed lines in FIG. 4.

Figure 5B:
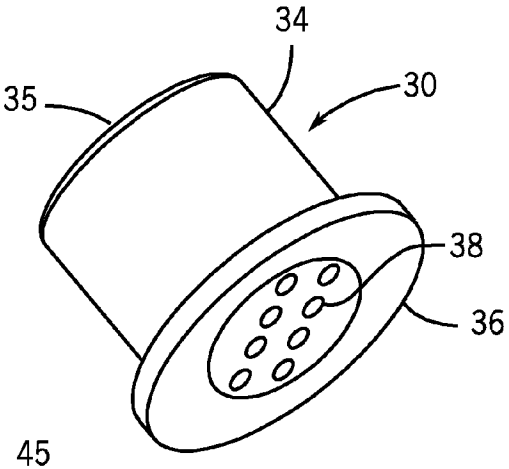
FIG. 5*b* illustrates a second view of the isometric drawing of the first embodiment of the inertial igniter of FIG. 5*a* showing the openings that are provided to exit the ignition sparks and flames into the thermal battery.
Figure 5C:
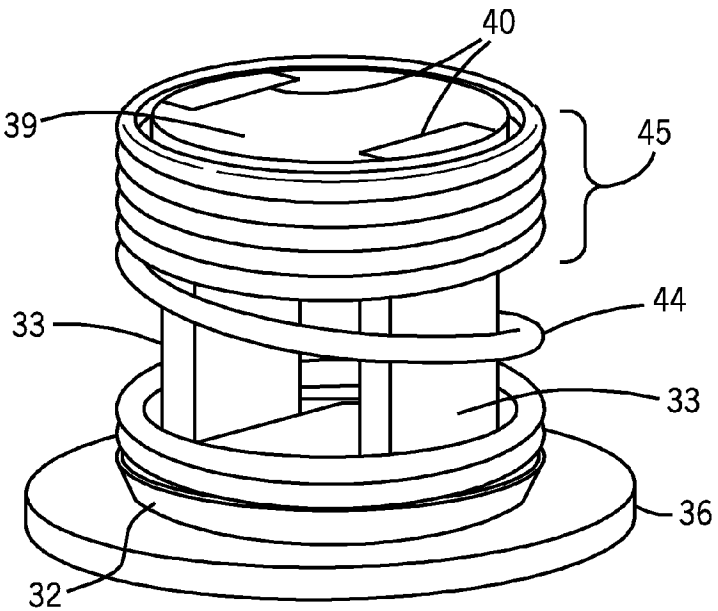
FIG. 5*c* illustrates a schematic of the isometric drawing of a first embodiment of an inertial igniter of FIG. 5*a* without the outer housing (side wall and top cap) of the inertial igniter.
Figure 5A:
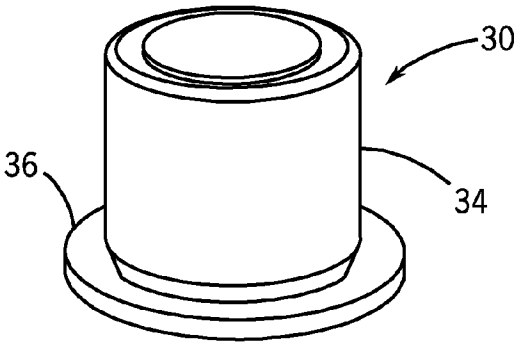
FIG. 5*a* illustrates a schematic of the isometric drawing of a first embodiment of an inertial igniter together with the top cap of a thermal battery to which it is attached.

The inertial igniter 30 with the thermal battery top cap 36 is shown in the isometric drawings of FIGS. 5*a* and 5*b*. The inertial igniter without its housing 34 and top cap 35 is shown in the isometric drawing of FIG. 5*c*. The base of the housing 32 is also provided with at least one opening 38 (with corresponding openings in the thermal battery top cap 36) to allow the ignited sparks and lire to exit the inertial igniter into the thermal battery 37 upon initiation of the inertial igniter pyrotechnics 46 and 47. FIG. 4, or percussion cap primer when used in place of the pyrotechnics 46 and 47 (not shown).

A striker mass 39 is shown in its locked position in FIGS. 4 and 5*c*. The striker mass 39 is provided with vertical recesses 40 that are used to engage the posts 33 and serve as guides to allow the striker mass 39 to ride down along the length of the posts 33 without rotation with an essentially pure up and down translational motion. In its illustrated position in FIGS. 4 and 5*c*, the striker mass 39 is locked in its axial position to the posts 33 by at least one setback locking ball 42. The setback locking ball 42 locks the striker mass 39 to the posts 33 of the inertial igniter body 31 through the holes 41 provided in the posts 33 and a concave portion such as a dimple (or groove) 43 on the striker mass 39 as shown in FIG. 4. A setback spring 44 with essentially dead coil section 45, which is preferably in compression, is also provided around but close to the posts as shown in FIGS. 4 and 5*c*. In the configuration shown in FIG. 4, the locking balls 42 are prevented from moving away from their aforementioned locking position by the dead coil section 45 of the setback spring 44. The dead coil section 45 can ride up and down beyond the posts 33 as shown in FIGS. 4 and 5*c*, but is biased to stay in its upper most position as shown in the schematic of FIG. 4 by the setback spring 44.

In this embodiment, a two-part pyrotechnics compound is shown to be used. FIG. 4. One part of the two-part pyrotechnics compound 47 (e.g., potassium chlorate) is provided on the interior side of the base 32, preferably in a provided recess (not shown) over the exit holes 38. The second part of the pyrotechnics compound (e.g., red phosphorous) 46 is provided on the lower surface of the striker mass surface 39 facing the first part of the pyrotechnics compound 47 as shown in FIG. 4. The surfaces to which the pyrotechnic parts 46 and 47 are attached are roughened and/or provided with surface cuts, recesses, or the like as commonly used in the art (not shown) to ensure secure attachment of the pyrotechnics materials to the applied surfaces.

In general, various combinations of pyrotechnic materials may be used for this purpose. One commonly used pyrotechnic material consists of red phosphorous or nano-aluminum, indicated as element 46 in FIG. 4, and is used with an appropriate hinder (such as vinyl alcohol acetate resin or nitrocellulose) to firmly adhere to the bottom surface of the striker mass 39. The second component can be potassium chlorate, potassium nitrate, or potassium perchlorate, indicated as element 47 in FIG. 4, and is used with a hinder (preferably but not limited to with such as vinyl alcohol acetate resin or nitrocellulose) to firmly attach the compound to the surface of the base 32 (preferably inside of a recess provided in the base 32—not shown) as shown in FIG. 4.

Figure 6:
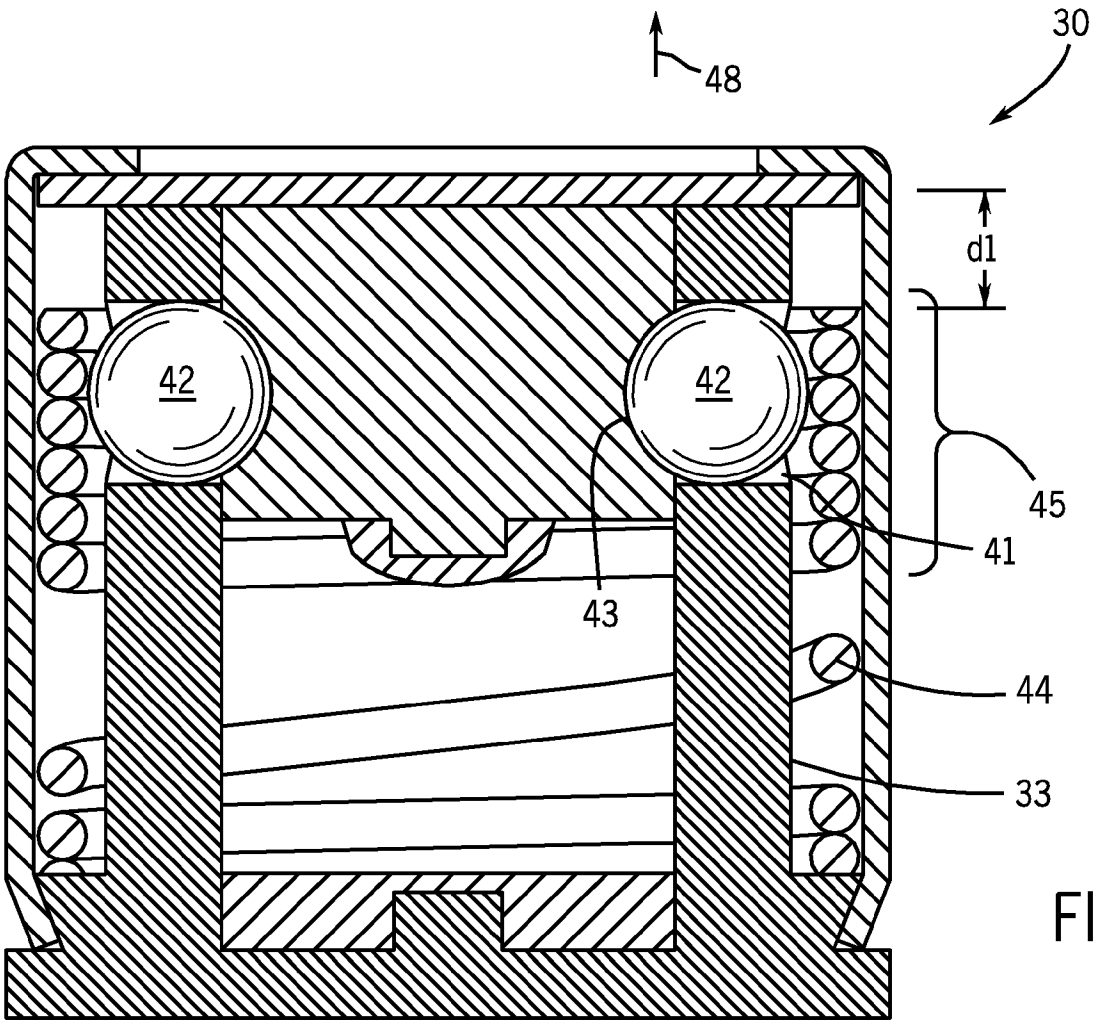
FIG. 6 illustrates the inertial igniter of FIG. 4 upon a non-firing accidental acceleration.

The basic operation of the disclosed inertial igniter 30 will now be described with reference to FIGS. 4-8. Any non-trivial acceleration in the axial direction 48 which can cause dead coil section 45 to overcome the resisting force of the setback spring 44 will initiate and sustain some downward motion of only the dead coil section 45. The force due to the acceleration on the striker mass 39 is supported at the dimples 43 by the locking balls 42 which are constrained inside the holes 41 in the posts 33. If an acceleration time in the axial direction 48 imparts a sufficient impulse to the dead coil section 45 (i.e. if an acceleration time profile is greater than a predetermined threshold), it will translate down along the axis of the assembly until the setback locking halls 42 are no longer constrained to engage the striker mass 39 to the posts 33 of the housing 31. If the acceleration event is not sufficient to provide this motion (i.e. the acceleration time profile provides less impulse than the predetermined threshold), the dead coil section 45 will return to its start (top) position under the force of the setback spring 44. The schematic of the inertial igniter 30 with the dead coil section 45 moved down certain distance d1 as a result of an acceleration event, which is not sufficient to unlock the striker mass 39 from the posts 33 of the housing 31, is shown in FIG. 6.

Figure 7:
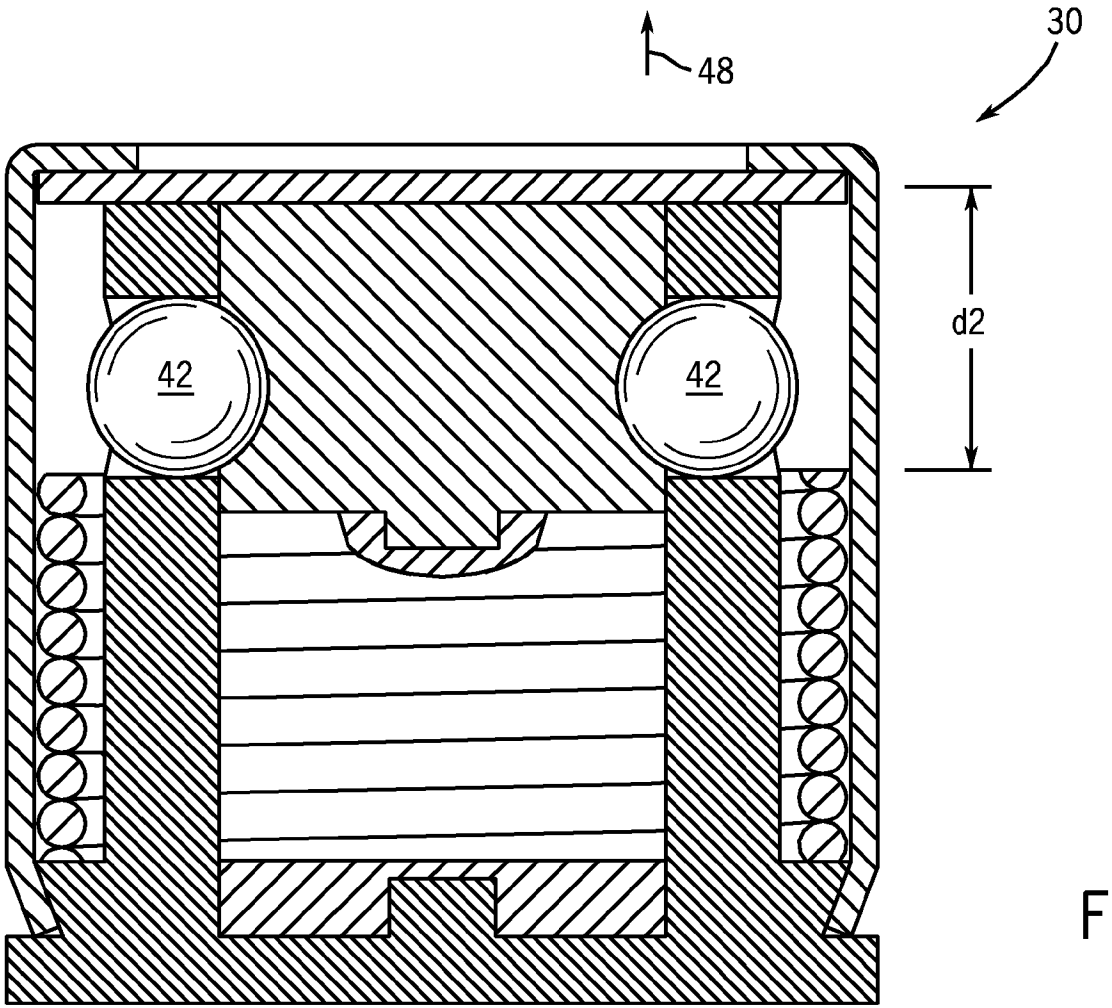
FIG. 7 illustrates the inertial igniter of FIG. 4 upon a firing acceleration.
Figure 8:
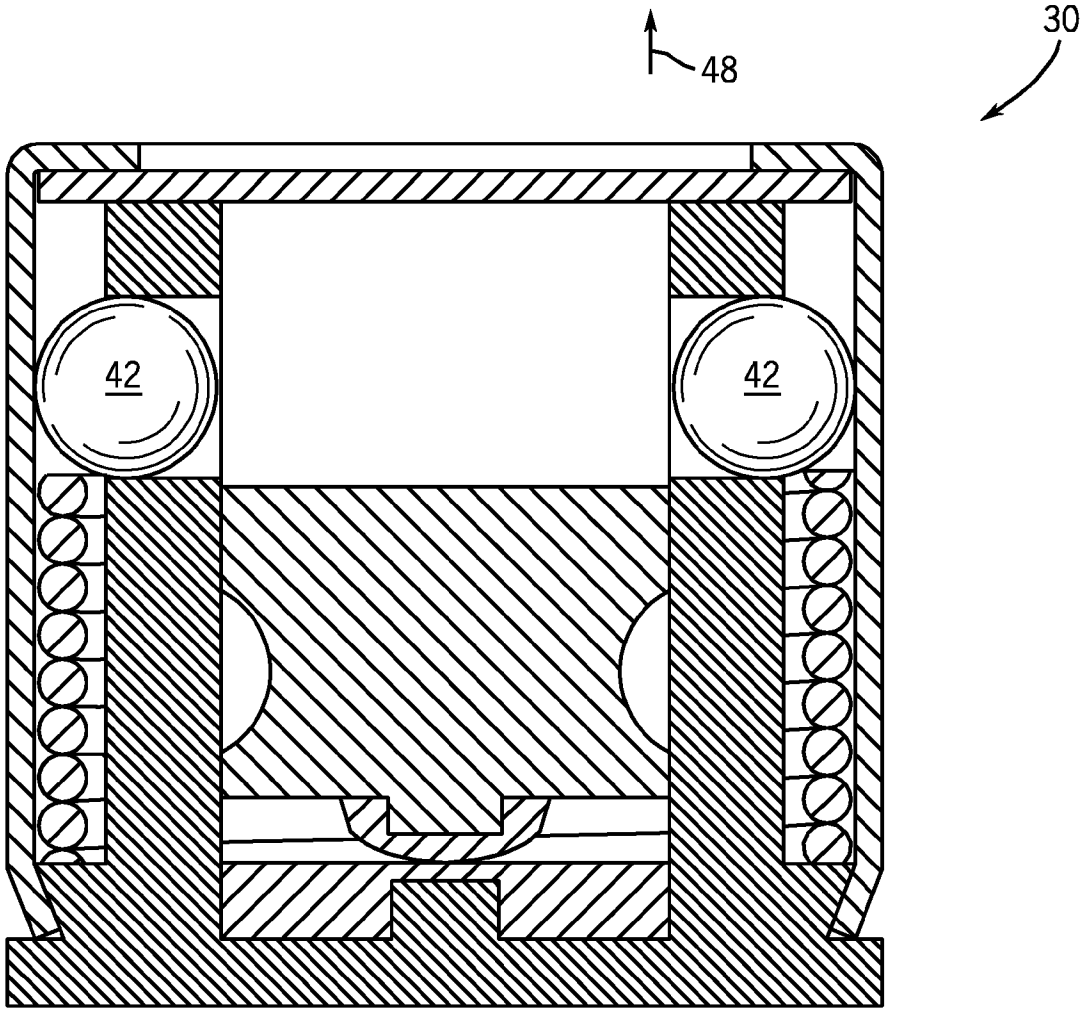
FIG. 8 illustrates the inertial igniter of FIG. 4 upon the striker mass impacting base, causing the initiation of ignition of the two-part pyrotechnic compound.

Assuming that the acceleration time profile was at or above the specified "all-fire" profile, the dead coil section 45 will have translated down full-stroke d2, allowing the striker mass 39 to accelerate down towards the base 32. In such a situation, since the locking halls 42 are no longer constrained by the dead coil section 45, the downward force that the striker mass 39 has been exerting on the locking balls 42 will force the locking balls 42 to move outward in the radial direction. Once the locking balls 42 are out of the way of the dimples 43, the downward motion of the striker mass 39 is impeded only by the elastic force of the setback spring 44, which is easily overcome by the impulse provided to the striker mass 39. As a result, the striker mass 39 moves downward, causing the parts 46 and 47 of the two-part pyrotechnic compound to strike with the requisite energy to initiate ignition. The configuration of the inertial igniter 30 when the balls 42 are free to move outward in the radial direction, thereby releasing the striker mass 39 is shown in the schematic of FIG. 7. The configuration of the inertial igniter 30 when the part 46 of the two-part pyrotechnic compound is striking the part 47 is shown in the schematic of FIG. 8.

In another embodiment, the dead coil section 45 may be constructed as a separate collar and positioned similarly over the setback spring 44. The collar replacing the dead coil section 45 may also be attached to the top coil of the setback spring 44, e.g., by welding, brazing, or adhesives such as epoxy, or the like. The advantage of attaching the collar to the top of the setback spring 44 is that it would help prevent it to get struck over the posts 33 as it is being pushed down by the applied acceleration in the direction of the arrow 48, FIGS. 6-8.

Alternatively, the dead coil section 45 and the setback spring 44 may be integral, made out of for example, a cylindrical section with spiral or other type shaped cuts over its lower section to provide the required axial flexibility to serve the function of the setback spring 44. The upper portion of this cylinder is preferably left intact to serve the function of the dead coil section 45, FIGS. 6-8.

It is appreciated by those skilled in the art that by varying the mass of the striker 39, the mass of the dead coil section 45, the spring rate of the setback spring 44, the distance that the dead coil section 45 has to travel downward to release the locking halls 42 and thereby release the striker mass 39, and the distance between the parts 46 and 47 of the two-part pyrotechnic compound, the designer of the disclosed inertial igniter 30 can match the lire and no-fire impulse level requirements for various applications as well as the safety (delay or dwell action) protection against accidental dropping of the inertial igniter and/or the munitions or the like within which it is assembled.

Briefly, the safety system parameters. i.e., the mass of the dead coil section 45, the spring rate of the setback spring 44 and the dwell stroke (the distance that the dead coil section 44 has to travel downward to release the locking halls 42 and thereby release the striker mass 39) must be tuned to provide the required actuation performance characteristics. Similarly, to provide the requisite impact energy, the mass of the striker 39 and the separation distance between the parts 46 and 47 of the two-part pyrotechnic compound must work together to provide the specified impact energy to initiate the pyrotechnic compound when subjected to the remaining portion of the prescribed initiation acceleration profile after the safety system has been actuated.

Figure 2:
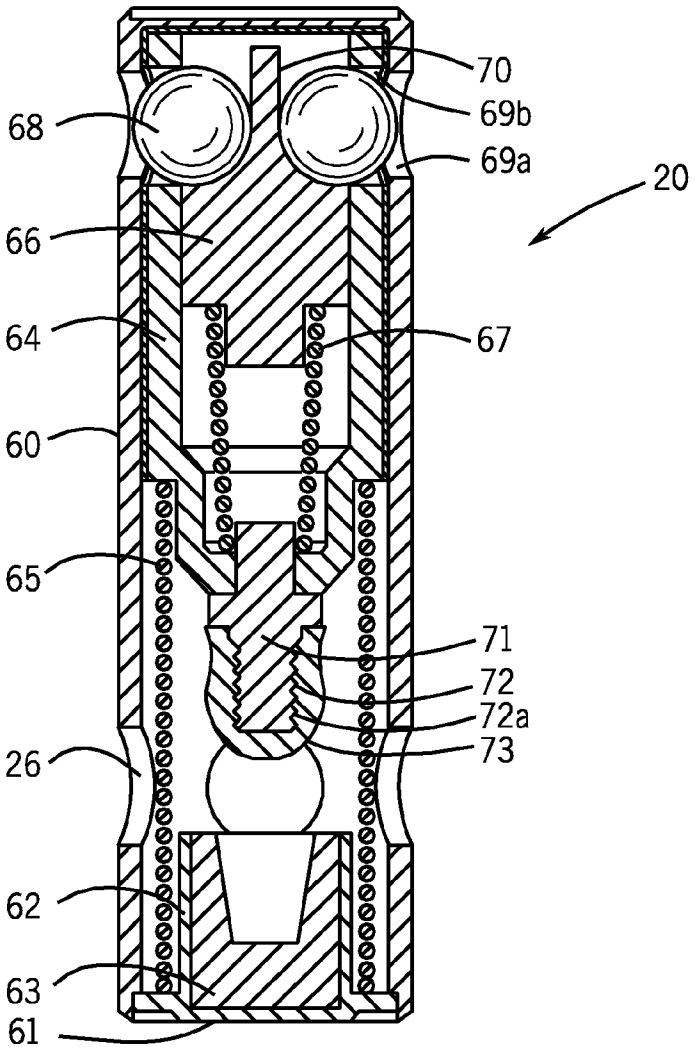
FIG. 2 PRIOR ART
FIG. 2 illustrates a schematic of a cross-section of a conventional inertial igniter assembly known in the art.

In addition, since the safety and striker systems each require a certain actuation distance to achieve the necessary performance, the most axially compact design is realized by nesting the two systems in parallel as it is done in the embodiment of FIG. 4. It is this nesting of the two safety and striker systems that allows the height of the disclosed inertial igniter to be significantly shorter than the currently available inertial igniter design (as shown in FIG. 2), in which the safety and striker systems are configured in series. In fact, an initial prototype of the disclosed inertial igniter 30 has been designed to the fire and no-fire and safety specifications of the currently available inertial igniter shown in FIG. 2 and has achieved height and volume reductions of over 60 percent. It is noted that by optimizing the parameters of the disclosed inertial igniter, both height and volume can be further reduced.

Figure 9:
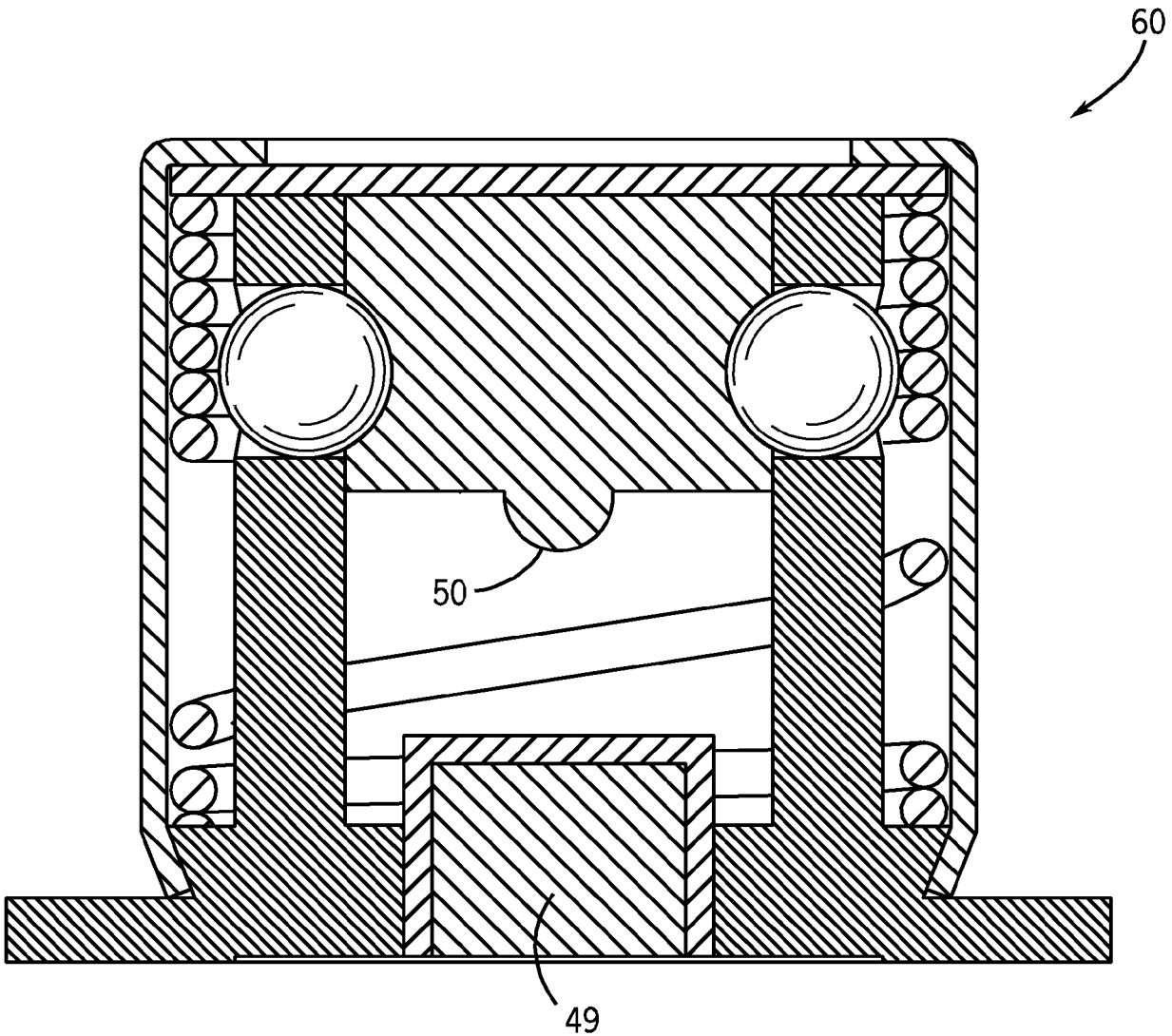
FIG. 9 illustrates a schematic of a cross-section of a second embodiment of an inertial igniter in a locked position.

In another embodiment, the two-part pyrotechnics 46 and 47, FIG. 4, are replaced by a percussion cap primer 49 attached to the base 32 of the inertial igniter 60 and a striker tip 50 as shown in the schematic of a cross-section of FIG. 9. In this illustration, all components are the same as those shown in FIG. 4 with the exception of replacing the percussion cap primer 49 and the striker tip 50 with striker assembly. The striker tip 50 is firmly attached to the striker mass 39.

The striker mass 39 and striker tip 50 may be a monolithic design with the striking tip 50 being a machined boss protruding from the striker mass, or the striker tip 50 may be a separate piece pressed or otherwise permanently fixed to the striker mass. A two-piece design would be favorable to the need for a striker whose density is different than steel, but whose tip would remain hard and tough by attaching a steel ball, hemisphere, or other shape to the striker mass. A monolithic design, however, would be generally favorable to manufacturing because of the reduction of part quantity and assembly operations.

Figure 1:
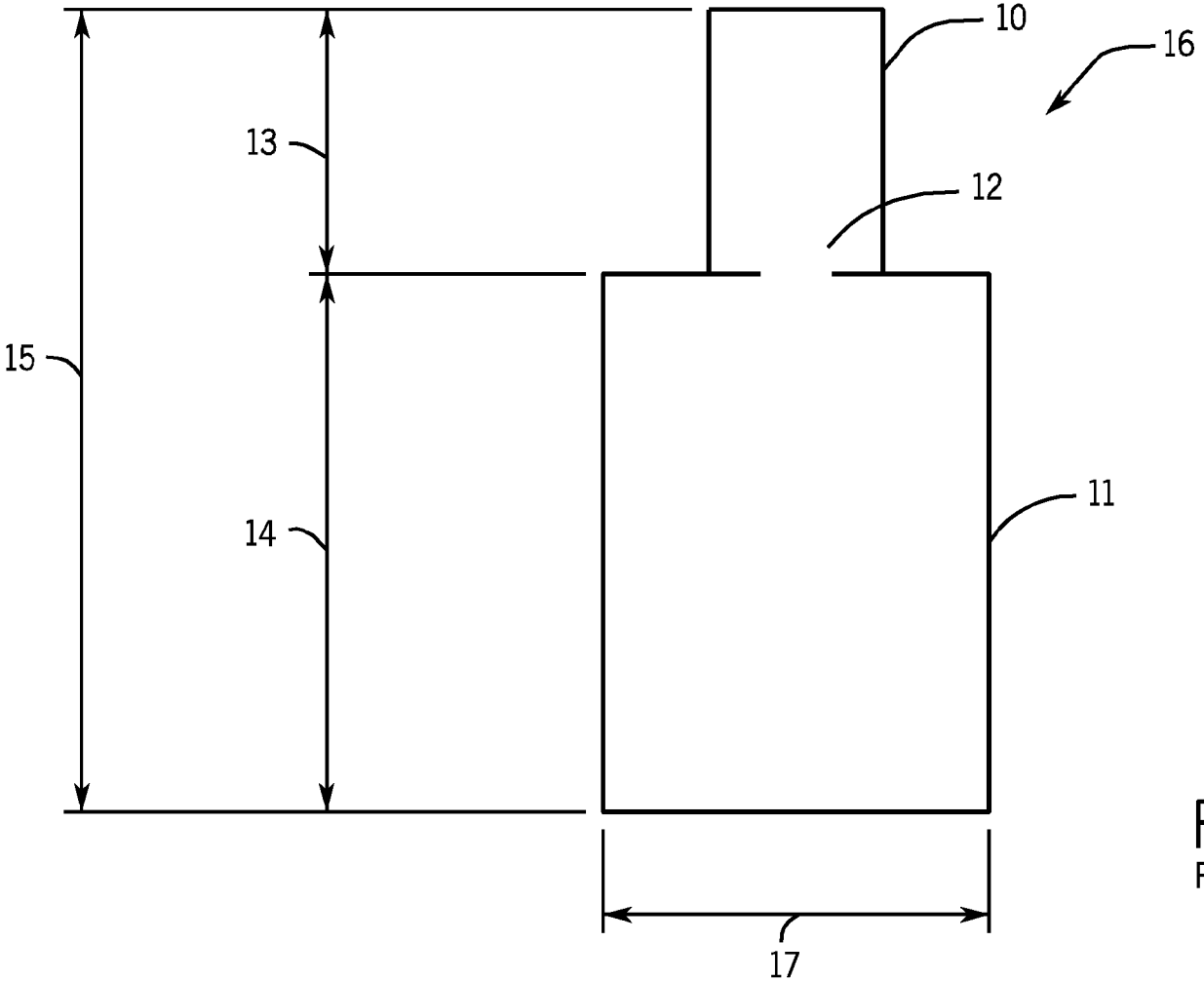
FIG. 1 PRIOR ART
FIG. 1 illustrates a schematic of a cross-section of a thermal battery and inertial igniter assembly.

An advantage of using the two component pyrotechnic materials as shown in FIG. 4 is that these materials can be selected such that ignition is provided at significantly lower impact forces than are required for commonly used percussion cap primers. As a result, the amount of distance that the striker mass 39 has to travel and its required mass is thereby reduced, resulting in a smaller total height (shown as 15 in FIG. 1) of the thermal battery assembly. This choice, however, has the disadvantage of not using standard and off-the-shelf percussion cap primers, thereby increasing the component and assembly cost of the inertial igniter.

Figure 3:
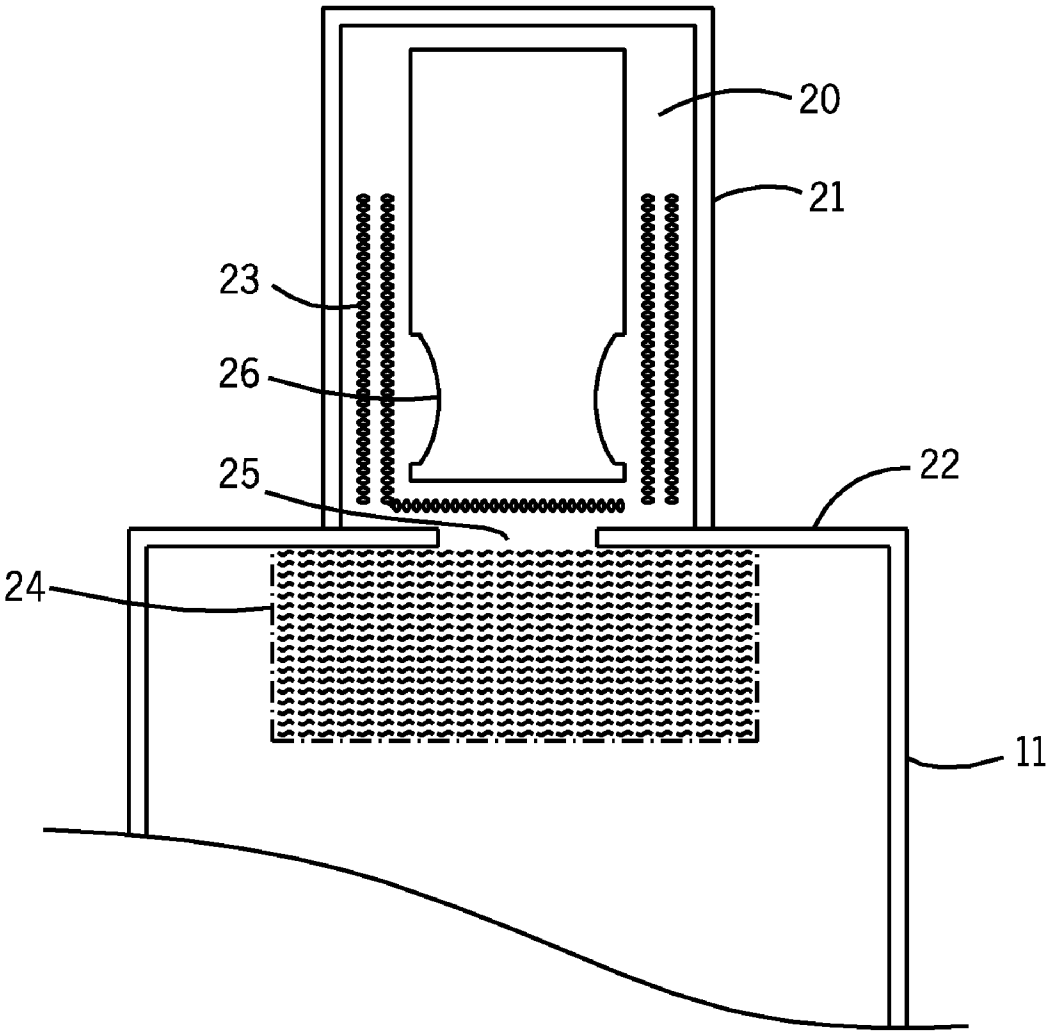
FIG. 3 PRIOR ART
FIG. 3 illustrates a schematic of a cross-section of a conventional inertial igniter assembly known in the art positioned within a housing and having intermediate materials for FIG. 4 illustrates a schematic of a cross-section of a first embodiment of an inertial igniter in a locked position.

The disclosed inertial igniters are seen to discharge the ignition fire and sparks directly into the thermal battery. FIGS. 4-9, to ignite the pyrotechnic materials 24 within the thermal batten 11 (FIG. 3). As a result, the additional housing 21 and ignition material 23 shown in FIG. 3 can be eliminated, greatly simplifying the resulting thermal battery design and manufacture. In addition, the total height 13 and volume of the inertial igniter assembly 10 and the total height 15 of the complete thermal battery assembly 16 are reduced, thereby reducing the total volume that has to be allocated in munitions or the like to house the thermal battery.

The disclosed inertial igniters are shown sealed within their housing, thereby simplifying their storage and increase their shelf life.

Figure 10:
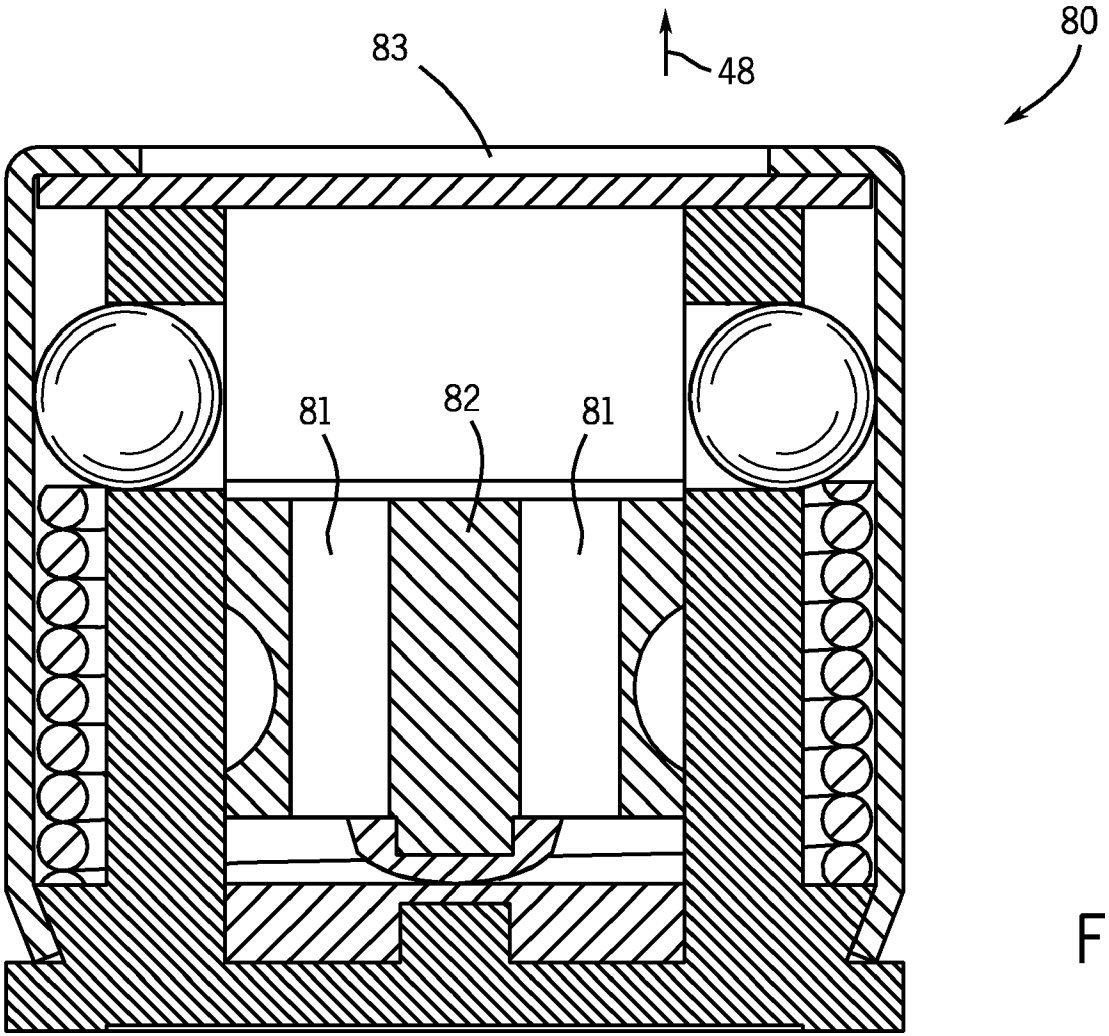
FIG. 10 illustrates a schematic of a cross-section of a third embodiment of an inertial igniter in initiation position.

FIG. 10 shows the schematic of a cross-section of another embodiment 80. This embodiment is similar to the embodiment shown in FIGS. 4-8, with the difference that the striker mass 39 (FIGS. 4-8) is replaced with a striker mass 82, with at least one opening passage 81 to guide the ignition flame up through the igniter 80 to allow the pyrotechnic materials (or the like) of a thermal battery (or the like) positioned above the igniter 80 (not shown) to be initiated. In addition, the top cap 35 (FIG. 4-8) is preferably eliminated or replaced by a cap 83 with appropriately positioned openings to allow the flames to enter the thermal battery and initiate its pyrotechnic materials. The openings 38 (FIG. 5*b*) are obviously no longer necessary.

Figure 11B:
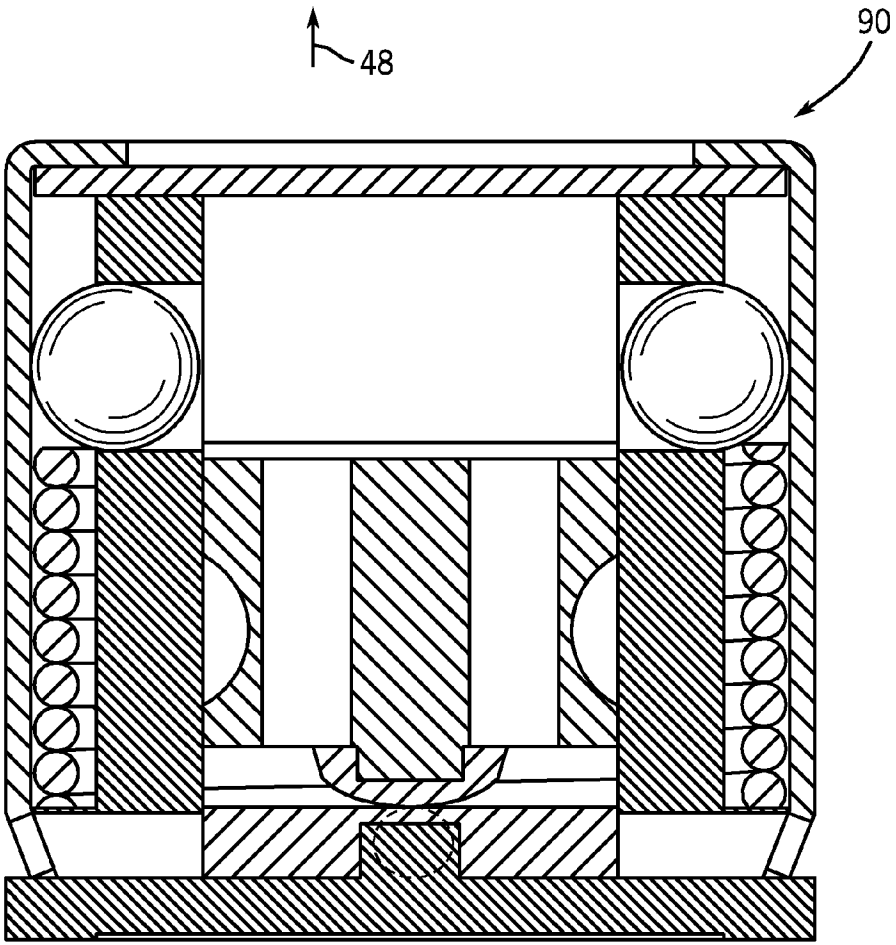
FIGS. 11*a* and 11*b* illustrate an isometric and a schematic of a cross-section, respectively, of a fourth embodiment of an inertial igniter in initiation position.
Figure 11A:
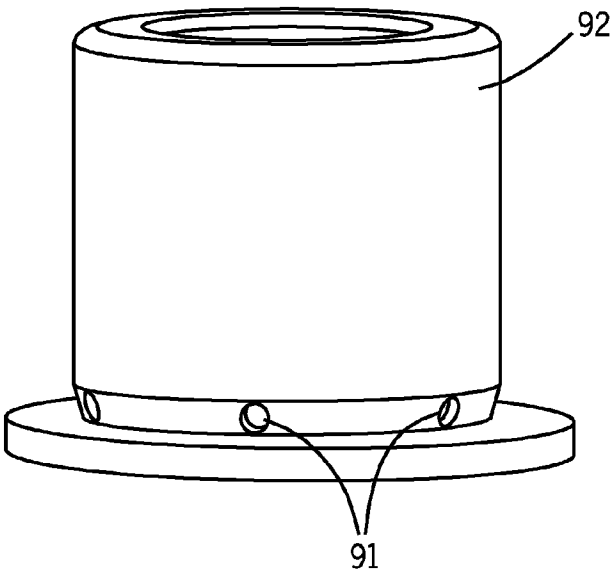

FIG. 11*b* shows the schematic of a cross-section of another embodiment 90. This embodiment is similar to the embodiment shown in FIGS. 4-8, with the difference that the openings 38 (FIG. 5*b*) for the flame to exit the igniter 30 is replaced with side openings 91. FIG. 11*a*, to allow the flame to exit from the side of the igniter to initiate the pyrotechnic materials (or the like) of a thermal battery or the like (not shown) that is positioned around the body of the igniter 90. Alternatively, the igniter housing 92 may be eliminated, thereby allowing the generated ignition flames to directly flow to the sides of the igniter 90 and initiate the pyrotechnic materials of the thermal battery or the like.

Figure 12:
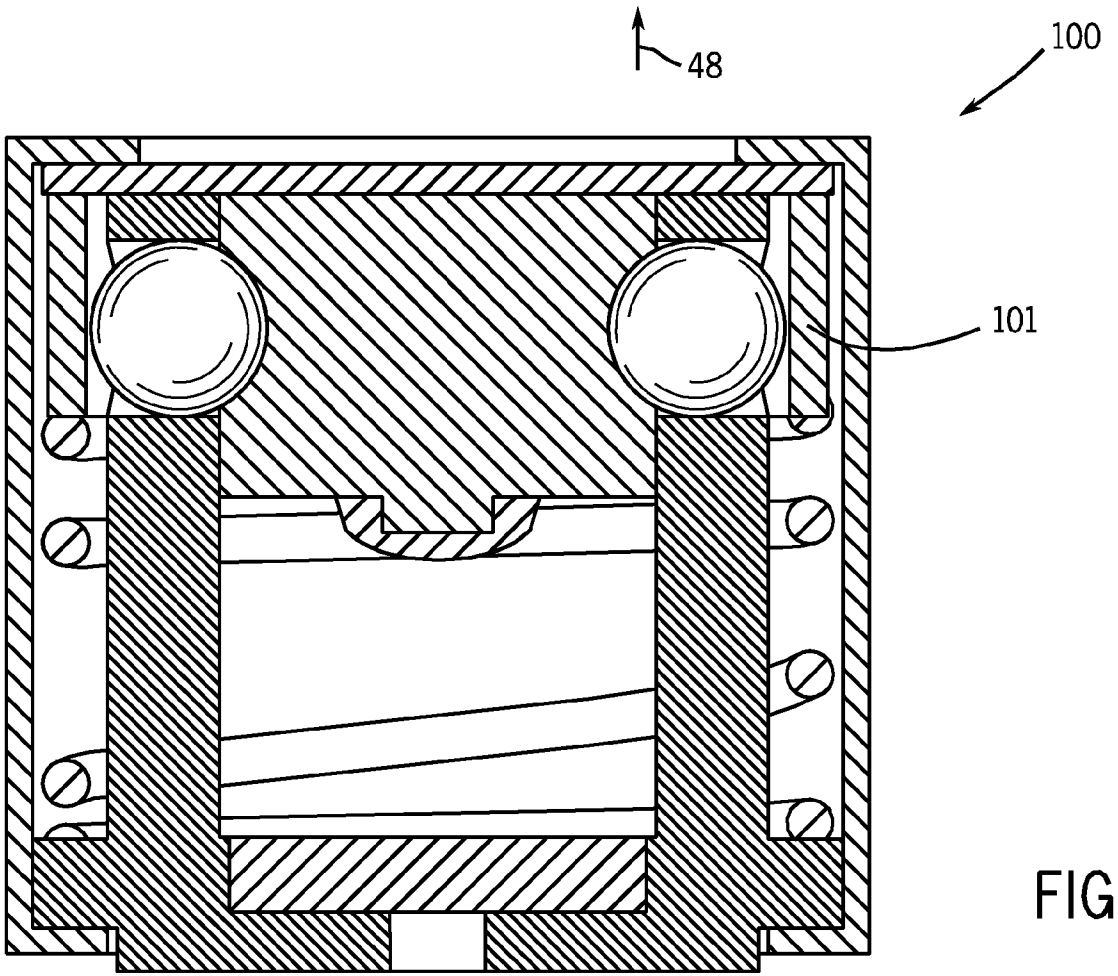
FIG. 12 illustrates a schematic of a cross-section of a fifth embodiment of an inertial igniter in a locked position.

FIG. 12 shows the schematic of a cross-section of another embodiment 100. This embodiment is similar to the embodiment shown in FIGS. 4-8, with the difference that the dead coil section 45 (FIGS. 4-5) is replaced with a solid, preferably relatively very rigid, cylindrical section 101. The advantage of using a rigid cylindrical section 101 is that the balls 42 (FIGS. 4-5) would not tend to cause the individual coils of the dead coil section 45 to move away from their cylindrically positioned configuration, thereby increasing the probability that the dead coil section could get stuck by the friction forces due to the pressure exerted by the halls 42 to the interior of the housing 34 (FIG. 4) or other similar possible scenarios.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An inertial igniter for use with a thermal battery for producing power upon acceleration, the inertial igniter comprising:

a base;

two or more posts extending from the base;

a mass movable towards the base, the mass having a recess at least partially corresponding to each of the two or more posts for guiding movement of the mass towards the base, each post further having a hole and the mass further having two or more concave portions;

a locking ball disposed in each of the holes, each locking ball having a portion disposed in the concave portion for preventing relative movement of the mass with the base when an acceleration time profile is below a predetermined threshold; and a biasing spring including a portion for preventing the locking balls from leaving the concave portion when the acceleration time profile is below the predetermined threshold and for allowing the locking balls to leave the concave portion when the acceleration time profile is below the predetermined threshold to unlock the mass and permit movement of the mass relative to the base.

2. The inertial igniter of claim 1, wherein the mass further includes one of a two part pyrotechnic materials and the base further includes another of the two part pyrotechnic materials.

3. The inertial igniter of claim 2, wherein the base further has one or more openings for allowing an ignition fire resulting from the striking of the two part pyrotechnic materials to exit therethrough for direct initiation of pyrotechnic materials in a thermal battery attached to the base.

4. The inertial igniter of claim 1, wherein the portion of the biasing means comprises a dead coil section of the biasing spring.

5. The inertial igniter of claim 1, wherein the portion of the biasing means comprises a collar attached to the biasing spring.

6. The inertial igniter of claim 1, further comprising a housing for accommodating at least the two posts, mass, locking ball and biasing spring.

7. The inertial igniter of claim 6, wherein the housing comprises a wall portion and a top cap portion.

8. The inertial igniter of claim 1, wherein the concave portion is one of a groove or dimple formed on an outer surface of the mass.

9. An inertial igniter and thermal battery assembly for producing power upon acceleration, the assembly comprising:

an inertial igniter comprising:

a base;

two or more posts extending from the base;

a mass movable towards the base, the mass having a recess at least partially corresponding to each of the two or more posts for guiding movement of the mass towards the base, each post further having a hole and the mass further having two or more concave portions;

a locking ball disposed in each of the holes, each locking ball having a portion disposed in the concave portion for preventing relative movement of the mass with the base when an acceleration time profile is below a predetermined threshold;

a biasing spring including a portion for preventing the locking balls from leaving the concave portion when the acceleration time profile is below the predetermined threshold and for allowing the locking balls to leave the concave portion when the acceleration time profile is below the predetermined threshold to unlock the mass and permit movement of the mass relative to the base; and wherein the mass further includes one of a two part pyrotechnic materials and the base further includes another of the two part pyrotechnic materials; and a thermal battery having a pyrotechnic material and operatively connected to the inertial igniter such that an ignition fire resulting from the striking of the two part pyrotechnic materials ignites the pyrotechnic material of the thermal battery.

10. The assembly of claim 9, wherein the mass further includes one of a two part pyrotechnic materials and the base further includes another of the two part pyrotechnic materials.

11. The assembly of claim 10, wherein the base further has one or more openings for allowing an ignition fire resulting from the striking of the two part pyrotechnic materials to exit therethrough for direct initiation of pyrotechnic materials in a thermal battery attached to the base.

12. The assembly of claim 9, wherein the portion of the biasing means comprises a dead coil section of the biasing spring.

13. The assembly of claim 9, wherein the portion of the biasing means comprises a collar attached to the biasing spring.

14. The assembly of claim 9, further comprising a housing for accommodating at least the two posts, mass, locking ball and biasing spring.

15. The assembly of claim 14, wherein the housing comprises a wall portion and a top cap portion.

16. The assembly of claim 9, wherein the concave portion is one of a groove or dimple formed on an outer surface of the mass.

17. An inertial igniter for use with a thermal battery for producing power upon acceleration, the inertial igniter comprising:

a base;

a post extending from the base;

a mass movable towards the base, the mass having a recess at least partially corresponding to the post for guiding movement of the mass towards the base, the post further having a hole and the mass further having a concave portion;

a locking ball disposed in the hole, the locking ball having a portion disposed in the concave portion for preventing relative movement of the mass with the base when an acceleration time profile is below a predetermined threshold; and a biasing spring including a portion for preventing the locking ball from leaving the concave portion when the acceleration time profile is below the predetermined threshold and for allowing the locking ball to leave the concave portion when the acceleration time profile is below the predetermined threshold to unlock the mass and permit movement of the mass relative to the base.

18. The inertial igniter of claim 17, wherein the mass further includes one of a two part pyrotechnic materials and the base further includes another of the two part pyrotechnic materials.

19. The inertial igniter of claim 18, wherein the base further has one or more openings for allowing an ignition fire resulting from the striking of the two part pyrotechnic materials to exit therethrough for direct initiation of pyrotechnic materials in a thermal battery attached to the base.

20. The inertial igniter of claim 17, wherein the portion of the biasing means comprises a dead coil section of the biasing spring.

21. The inertial igniter of claim 17, wherein the portion of the biasing means comprises a collar attached to the biasing spring.

22. The inertial igniter of claim 17, further comprising a housing for accommodating at least the post, mass, locking ball and biasing spring.

23. The inertial igniter of claim 22, wherein the housing comprises a wall portion and a top cap portion.

24. The inertial igniter of claim 17, wherein the concave portion is one of a groove or dimple formed on an outer surface of the mass.

* * * * *